United States Patent [19]

Barber

[11] 4,227,722

[45] Oct. 14, 1980

[54] TOILET SOIL PIPE FLANGE FASTENER

[76] Inventor: Luther J. Barber, 3174 Miller Rd., Lithonia, Ga. 30058

[21] Appl. No.: 959,689

[22] Filed: Nov. 13, 1978

Related U.S. Application Data

[63] Continuation-in-part of Ser. No. 829,472, Aug. 31, 1977, abandoned.

[51] Int. Cl.[3] ..... E03D 11/13; F16B 35/04; F16L 3/00; F16L 23/02

[52] U.S. Cl. ..... 285/56; 4/252 R; 52/585; 85/1 K; 85/9 R; 151/41.76; 285/24; 285/58; 403/13; 403/22; 403/408

[58] Field of Search ..... 285/56, 57, 58, 59, 285/60, 24, 27, 18, 368, 412; 151/44; 4/252 R, 419, 170, 417; 403/14, 408, 13, 375, 380, 332; 85/32 K, 9 R, 1 H, 1 K, 1 P; 248/544

[56] References Cited

U.S. PATENT DOCUMENTS

| | | | |
|---|---|---|---|
| 287,795 | 11/1883 | Blighton | 403/408 X |
| 408,897 | 8/1889 | Scott | 285/56 |
| 628,004 | 7/1899 | Hinsdale | 285/58 |
| 939,001 | 11/1909 | Forster et al. | 285/59 |
| 1,031,531 | 7/1912 | Cramer | 285/56 |
| 1,825,195 | 9/1931 | McAvoy et al. | 52/585 X |
| 2,787,051 | 4/1957 | Risley | 85/1 P X |
| 3,180,660 | 4/1965 | Brewington | 285/60 |
| 3,181,585 | 5/1965 | Brewington | 285/60 X |
| 3,339,215 | 9/1967 | Flood | 285/58 X |
| 4,070,120 | 1/1978 | Bald et al. | 403/13 |

FOREIGN PATENT DOCUMENTS

| | | | |
|---|---|---|---|
| 2813119 | 10/1978 | Fed. Rep. of Germany | 285/363 |
| 1520408 | 3/1968 | France | 52/79.13 |

*Primary Examiner*—Roy D. Frazier
*Assistant Examiner*—Carl F. Pietruszka
*Attorney, Agent, or Firm*—Jones, Thomas & Askew

[57] ABSTRACT

An improved device for securing a toilet to a soil pipe flange includes a flange fastening nut comprising a guide member and a retaining member connected by a shaft for slidably engaging a slot in the flange, the guide member being above the slot for guiding an opening in the base of the toilet into proper position over the fastening nut, the guide member including a tapped hole into which a bolt may be screwed from above the base of the toilet to secure the toilet to the flange. The invention may also be embodied in a soil pipe flange having a plurality of guide members each including a tapped hole fixedly attached to the upper surface of the flange in positions matching the openings in the base of the toilet.

3 Claims, 9 Drawing Figures

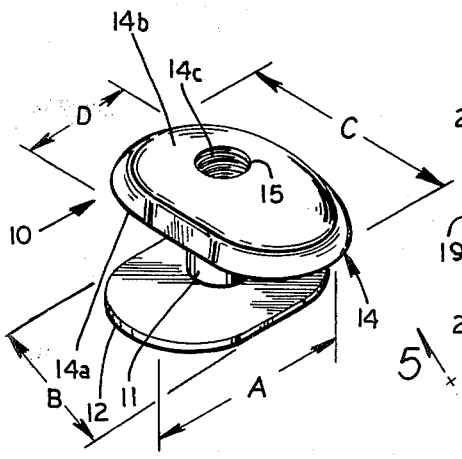
FIG. 1
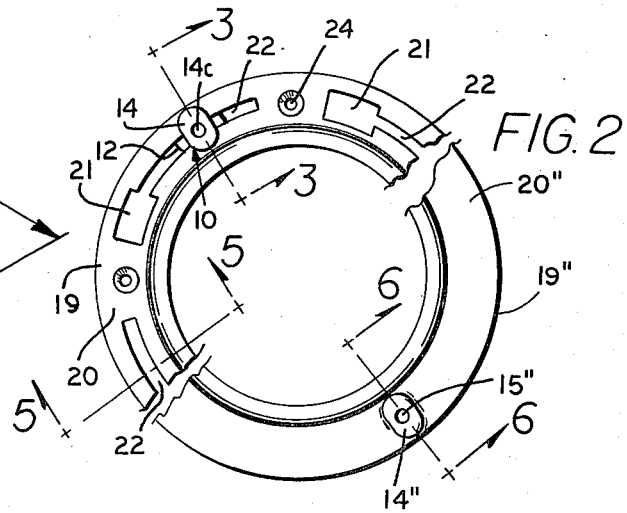
FIG. 2
FIG. 8
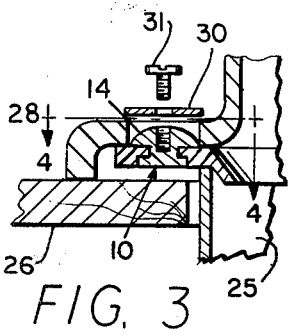
FIG. 3
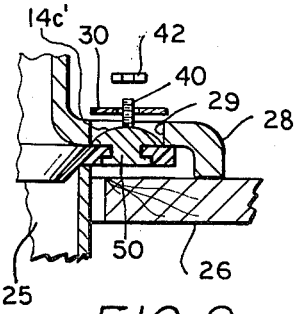
FIG. 9
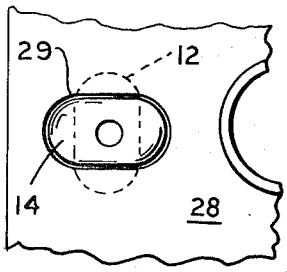
FIG. 4
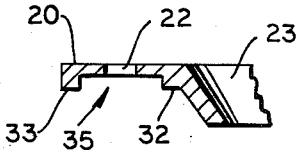
FIG 5
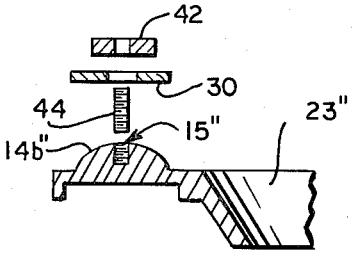
FIG. 6
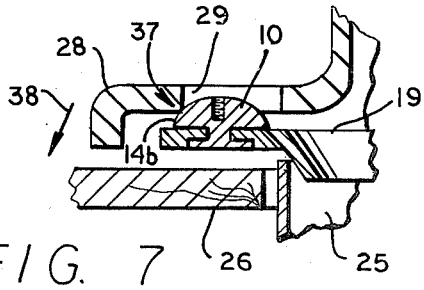
FIG. 7

TOILET SOIL PIPE FLANGE FASTENER

CROSS-REFERENCE TO RELATED APPLICATION

This application is a continuation-in-part of U.S. application Ser. No. 829,472, filed Aug. 31, 1977 and now abandoned.

DESCRIPTION

Background of the Invention

The present invention relates to devices for securing toilets to soil pipe flanges. In the installation of toilets, according to the present generally accepted practice, a slotted flange is leaded to the soil pipe which leads into the drainage pipe system of the building. A plurality of bolts having generally flat retaining members fixed to one end thereof are inserted into slots in the soil pipe flange and stand loosely within the slots with the retaining members resting on the floor beneath the soil pipe flange. The bulky toilet must then be lifted and placed on the flange so that the upwardly extending bolts pass through openings in the base of the toilet. Since the bolts normally are standing loosely within the slots, the toilet must be accurately placed in order to avoid tilting the bolts out of line with the openings or knocking them over. It may be difficult to make the bolt stand up straight if the floor under the flange is uneven.

An example of the usual system for fastening a toilet to a soil pipe flange is shown in U.S. Pat. No. 800,664.

When the toilet has been set in place with the bolts projecting through the openings in the base of the toilet, a washer is placed over the bolt and a nut is screwed onto the bolt. Often there is enough space between the soil pipe flange and the floor so that the retaining member on the lower end of the bolt may be resting below ridges on the bottom side of the soil pipe flange which are intended to prevent the retaining member from turning relative to the flange. If this occurs, the bolt must be long enough so that it can be grasped above the washer and held up against the flange within the ridges so that it will not turn while the nut is being applied. In anticipation of this problem the bolts are generally made quite long so that they must be sawed off above the nut to allow the placement of decorative porcelain caps over the bolt and nut. The sawing off of the bolt may damage the threads and make it very difficult to remove the nut from the bolt when it is desired to lift the toilet off the soil pipe flange at a later date. Furthermore, during loosening of the nut, the retaining member may drop below the soil pipe flange and spin freely. In either of these instances it may be necessary to saw off the bolt between the nut and the washer or between the washer and the toilet base.

It has been proposed to improve the usual system for securing a toilet by providing a washer to prevent the retaining member from falling, as shown in U.S. Pat. No. 3,339,215. Such a bolt apparatus, however, provides only a slim bolt projecting upwardly and no means for engaging the toilet at the openings therein and guiding the toilet into proper position.

In U.S. Pat. No. 404,874, a special flange is disclosed including a cross-shaped slot for receiving the retaining member of a toilet hold-down bolt, the shaft of which projects upwardly and receives a nut threaded onto the bolt from above the toilet. Another variation, exemplified by U.S. Pat. Nos. 952,602 and 1,548,850, includes a bolt threaded on both ends so that it may be threaded into a tapped hole in a flange and thereafter a nut may be threaded onto the shaft from above the toilet. All of these patents share the disadvantage that they cannot be used with the present day standard soil pipe flange. None of these patents disclose a system, and wherein the nut portion is shaped to guide the toilet into position on the soil pipe flange.

Summary of the Invention

The present invention avoids many of the problems associated with prior art devices for securing toilets to soil pipes by providing an apparatus for positioning a toilet with respect to a soil pipe and securing the toilet comprising a support member fixed to the soil pipe; a guide member carried by said support member having an inclined guiding surface whereby the toilet at an opening therein slidably engages the inclined surface and is guided into position, said guide member extending into the opening in the toilet when the toilet is positioned with respect to the soil pipe; and a means for securing said toilet against said support member. The securing means may be a bolt biased against the toilet and extending through the opening therein into a tapped hole in the vertex of the guide member, or a threaded rod extending upwardly from the guide member to receive a nut biased against the toilet, or a threaded rod threaded into a tapped hole in the guide member and receiving a nut biased against the toilet.

It is therefore an object of the present invention to provide an improved means for securing a toilet to a soil pipe flange.

Another object of the present invention is to provide an apparatus for guiding a toilet into position over a soil pipe.

Another object of the present invention is to provide a device for securing a toilet to a soil pipe flange which will allow installation of a toilet with less difficulty.

A further object of the present invention is to provide a device for securing a toilet to a soil pipe flange which will allow the toilet to be easily removed from the soil pipe flange at a later date.

BRIEF DESCRIPTION OF THE DRAWINGS

FIG. 1 is a pictorial view of a soil pipe flange nut according to the present invention.

FIG. 2 is a top view of half of a typical soil pipe flange showing a soil pipe flange nut according to the present invention slidably engaging a slot therein FIG. 3 is a side cross-sectional view taken along line 3—3 of FIG. 2, and showing in addition a toilet mounted on said soil pipe flange.

FIG. 4 is a top view of a soil pipe flange nut of the invention and a portion of a toilet taken along line 4—4 of FIG. 3.

FIG. 5 is a partial cross-sectional view of a typical soil pipe flange taken along line 5—5 of FIG. 2.

FIG. 6 is a cross-sectional view of a second embodiment of the invention taken along line 6—6 of FIG. 8 and shows an alternate securing means.

FIG. 7 is a cross-sectional view similar to FIG. 3, showing an out-of-line toilet engaging a nut according to the invention.

FIG. 8 is a top view of a portion of a soil pipe flange according to the embodiment of the invention shown in FIG. 6.

FiG. 9 is a side cross sectional view of a third embodiment of the invention installed with respect to a soil pipe and toilet.

DESCRIPTION OF THE PREFERRED EMBODIMENTS

Referring now in more detail to the drawing, in which like numerals indicate like parts throughout the several views, FIG. 1 shows a soil pipe flange nut according to the present invention. The nut includes a shaft 11, a generally flat lower retaining member 12 fixed to one end of the shaft 11, and a guide member 14 fixed to the other end of the shaft 11. The flat lower retaining member is oval in shape and has a longitudinal dimension A longer than its transverse dimension B, as shown in FIGS. 1 and 4. The guide member or upper retaining member 14 has the shape of half of an ovoid, as shown in FIG. 1, and has a flat base parallel to the lower retaining member, the base having an oval perimeter 14*a*. The guide member 14 also has a vertex point 14*c* and an inclined guiding surface 14*b* between the vertex 14*c* and the perimeter 14*a*. While the inclined surface 14*b* is shown as defining a half-ovoid, generally inclined surfaces defining other particular contours are within the concept of the invention. The base of the guide member 14 has a longitudinal dimension C greater than its transverse dimension D, as shown in FIG. 1.

The longitudinal dimension C of the guide member 14 is perpendicular to the longitudinal dimension of the lower retaining member 12, to allow the orientation of the guide member 14 to correspond to the position of an opening 29 in the base of a toilet 28, as shown in FIG. 4. However, the relative orientation of the guide member 14 and lower retaining member 12 may be chosen to allow the position of the guide member 14 to correspond to the position of openings in the bases of various toilets. The shape of the oval perimeter 14*a* is approximately the same as, but slightly smaller than, the shape of the opening 29.

The guide member 14 defines a vertical tapped hole 15 therein from the vertex 14*c* along the axis of the shaft 11. The tapped hole 15 may extend only into the guide member 14 or it may extend further into the shaft 11.

FIG. 2 shows half of a typical soil pipe flange 19 which may be formed of metal or plastic and includes a generally flat annular ring 20, holes 24 for receiving fasteners (not shown) to fix the flange 19 to a floor 26 (shown in FIG. 3), an inner annular lip 23 slanting downwardly from the inner edge of the ring 20 for engaging a soil pipe 25, and a plurality of slots 22 in the ring 20, each having an enlarged opening 21 at one end of the slot 22. As shown in FIG. 5, a shoulder 32 extending from the inner annular lip 23 and an outer annular lip 33 form a channel 35 under the annular ring 20. The width of the channel is slightly more than the transverse dimension of the lower retaining member 12.

It will therefore be seen by referring to FIG. 2 and FIG. 3 that a soil pipe flange nut as shown in FIG. 1 may be movably mounted on the slotted soil pipe flange 19 by inserting the first retaining member 12 downwardly into an opening 21 and by then sliding the shaft 11 along the slot 22. The length of the shaft 11 is only slightly longer than the thickness of the flat annular ring 20, so that the guide member 14 and the lower retaining member 12 hold the nut 10 in reasonably snug engagement with the ring 20. Thus the nut 10 according to the present invention is not subject to wobbling or tilting or resting on the floor 26 as was the case with some prior art bolts. Since the lower retaining member 12 is held in close proximity to the ring 20, it will be held at least partially within the channel 35 and the nut 10 will not spin freely, because the longitudinal dimension of the lower retaining member 12 is greater than the width of the channel 35. The nut 10 may be placed at a desired point along the slot 22 in line with the opening 29 in the base of the toilet 28 and the snug fit of the nut 10 with the ring 20 will maintain the nut in that selected position for ease of installation of the toilet.

The inclined surface of the guide member 14 provides a guiding surface 14*b* which will assist in guiding an opening 29 in the toilet 28 into the correct position over the nut 10 as the toilet 28 is lowered into place over the flange 19. FIG. 7 shows a toilet being lowered over a ring 19 in a position misaligned with respect to the nut 10. The edge of the opening 29 in the base 28 of the toilet therefore engages the inclined surface 14*b* of the guide member 14 at the point labeled 37 and tends to cause the toilet to slide in the direction indicated by the arrow 38 into correct position with respect to the nut 10 and the ring 19. Since the oval shape of the perimeter 14*a* of guide member 14 matches the oval shape of the opening 29, the guide member 14 is prevented from turning and therefore further prevents the nut 10 from turning freely while the toilet is being secured.

When the toilet 28 is in proper position as shown in FIG. 3, a washer 30 may be applied over the opening 29 in the toilet 28 and a bolt 31 inserted through the washer 30 and screwed into the tapped hole 15 to secure the toilet 28 to the soil pipe flange 19. Although bolt 31 is shown in FIG. 3 as having a slot for receiving a screwdriver, the head of the bolt may also be the conventional hexagonal shape for convenient use of a crescent or socket wrench. Alternately, as also shown in FIG. 9, in another embodiment 50 according to the invention, a threaded rod may extend from the vertex 14*c*′ of the guide member 14′ to project above the base 28 and receive a washer 30 and a nut 42. Or, a threaded rod 44 as shown in FIG. 6 may be threaded into the tapped hole 15 of a flange nut 10 to extend above the base 28 and receive the washer 30 and the nut 42.

It will thus be seen that by providing a flange nut which snugly fits a slotted soil pipe flange and receives a bolt screwed downwardly into the nut through an opening in the base of the toilet, the present invention provides for ease in the installation of toilets and eliminates the need for the long unstable bolts which have been generally previously used. The snug fit of the nut on the flange allows positive location of the nut which will not be easily moved out of position during installation of the toilet, and the inclined surface of the guide member 14 assists in positioning the toilet over the flange. When a bolt screwed down into a nut engaging the soil pipe flange is utilized, there is no occasion for sawing off a projecting bolt and no damage to the threads which would make later removal of the toilet difficult. The oval shape of the guide member 14 also assists in the removal of the bolt 31 since the guide member 14 bears against the inner surfaces of the oval opening 29 in the toilet 28 to prevent the nut 10 from turning during the extraction of the bolt 31.

In FIG. 6 and FIG. 8 another embodiment of the present invention is shown. In such embodiment guide members 14″ including tapped holes 15″ are fixed to the upper surface of a flat annular ring 20″ of a soil pipe flange 19″. The guide members 14″ are positioned according to the positions of openings 29 in a toilet base 28, and may be attached to the ring 20″ or formed as an integral part of the soil pipe flange 19″. When such embodiment is used, the soil pipe flange 19″ is installed over the soil pipe 25 with an orientation matching the desired orientation of the toilet within the room. The toilet is then secured to the soil pipe ring as described above. In this embodiment of the present invention no slots are required in the ring 20″ of the soil pipe flange 19″ so that the slots 22 may be eliminated to increase the strength of the soil pipe flange 19″. As well as having the advantages described above for the soil pipe flange nut, the soil pipe flange of FIG. 6 has the added advantage of being a single integral part, so that the toilet installer has fewer parts to purchase, inventory and keep track of on the job. Of course, any of the alternate fastening means described above may be used with the embodiment of FIG. 6, although only the means including threaded rod 44 is shown therewith.

While this invention has been described in detail with particular reference to preferred embodiments thereof, it will be understood that variations and modifications can be effected within the spirit and scope of the invention as described hereinbefore and as defined in the appended claims.

I claim:

1. A nut for threadably receiving a fastening means for securing a toilet defining an oval opening therein to a soil pipe flange, said flange including a horizontally disposed annular ring defining an arcuate slot therein and including downwardly extending annular lips at the inner and outer edges of said annular ring forming a channel under said annular ring, said fastening means being positioned to engage said toilet and extend downwardly through said opening to bias said toilet against said flange, and said nut comprising:

a vertically extending shaft having a diameter slightly less than the width of said arcuate slot and a length slightly longer than the thickness of said annular ring;

a flat lower retaining member fixed to the lower end of said shaft;

an upper retaining member defining a vertical tapped hole therein, and having a flat base fixed to the upper end of said shaft, said base having an oval perimeter, and said upper retaining member further defining an inclined guiding surface extending uniformly from the perimeter of said base upwardly to said vertical tapped hole;

said lower retaining member and said base of said upper retaining member being parallel to each other and perpendicular to said shaft, said flange receiving said shaft in said arcuate slot, said upper retaining member holding said lower retaining member at least partially within said channel, and said oval base being shaped to be loosely matingly received by said oval opening in said toilet and extending upwardly within said opening in said toilet when said toilet is positioned on said flange.

2. A nut for threadably receiving a fastening means for securing a toilet defining an oval opening therein to a soil pipe flange, said flange including a horizontally disposed annular ring defining an arcuate slot therein, said fastening means being positioned to engage said toilet and extend downwardly through said opening to bias said toilet against said flange, and said nut comprising:

a vertically extending shaft having a diameter slightly less than the width of said arcuate slot and a length slightly longer than the thickness of said annular ring;

a flat lower retaining member underlying said flange and fixed to the lower end of said shaft;

an upper retaining member defining a vertical tapped hole therein, and having a flat base fixed to the upper end of said shaft, said base having an oval perimeter overlying said flange, and said upper retaining member further defining an inclined guiding surface extending uniformly from the perimeter of said base upwardly to said vertical tapped hole;

said lower retaining member and said base of said upper retaining member being parallel to each other and perpendicular to said shaft, said flange receiving said shaft in said arcute slot, and said oval base being shaped to be loosely matingly received by said oval opening in said toilet and extending upwardly within said opening in said toilet when said toilet is positioned on said flange.

3. An article for threadably receiving a fastening means for securing a toilet defining an oval opening therein to a soil pipe flange, said flange including a horizontally disposed annular ring defining an arcuate slot therein and including downwardly extending annular lips at the inner and outer edges of said annular ring forming a channel under said annular ring, said fastening means being positioned to engage said toilet to bias said toilet against said flange, and said article comprising:

a vertically extending shaft having a diameter slightly less than the width of said arcuate slot and a length slighly longer than the thickness of said annular ring;

a flat lower retaining member fixed to the lower end of said shaft;

an upper retaining member including a threaded rod extending upwardly therefrom, and having a flat base fixed to the upper end of said shaft, said base having an oval perimeter, and said upper retaining member further defining an inclined guiding surface extending uniformly from the perimeter of said base upwardly to said threaded rod;

said lower retaining member and said base of said upper retaining member being parallel to each other and perpendicular to said shaft, said flange receiving said shaft in said arcuate slot, said upper retaining member holding said lower retaining member at least partially within said channel, and said oval base being shaped to be loosely matingly received by said oval opening in said toilet and extending upwardly within said opening in said toilet when said toilet is positioned on said flange.

* * * * *